United States Patent [19]

Marshall

[11] Patent Number: 4,484,947

[45] Date of Patent: Nov. 27, 1984

[54] METHOD FOR MELTING A CHARGE OF BULK SOLID METAL

[75] Inventor: Robert W. Marshall, DuBois, Pa.

[73] Assignee: North American Manufacturing Company, Cleveland, Ohio

[21] Appl. No.: 487,463

[22] Filed: Apr. 22, 1983

[51] Int. Cl.[3] ..... C22B 21/00

[52] U.S. Cl. ..... 75/65 R; 75/68 R

[58] Field of Search ..... 75/65 R, 68 R; 266/87, 266/901

[56] References Cited

U.S. PATENT DOCUMENTS

| | | | |
|---|---|---|---|
| 3,734,719 | 5/1973 | Estes et al. | 75/68 R |
| 4,021,192 | 5/1977 | Ferguson et al. | 266/901 |
| 4,264,060 | 4/1981 | Twyman | 266/87 |

*Primary Examiner*—M. J. Andrews

*Attorney, Agent, or Firm*—Body, Vickers & Daniels

[57] ABSTRACT

A method and system of melting a charge of metal in a closed hearth wherein the metal has a first high thermal conductivity when solid, a second low thermal conductivity when liquid and a given melting temperature below about 1600° F., such as aluminum. The method and system involves the use of a plurality of heaters having a total high heat capacity sufficient to melt the metal in a given time and sufficient to drastically increase the temperature of the metal when the metal is in the liquid state. This method and system comprises operating the burners at the high heat capacity until a control temperature associated with the hearth and separate from the metal reaches a given value, modulating the burners to maintain the control temperature generally at this given value, turning said burners to a minimum capacity drastically below the high heat capacity after only part of the metal has melted, then allowing the furnace to stabilize whereby thermal energy absorbed by the hearth is combined with the low heat capacity of the burners to finalize melting of the metal and modulating the burners to maintain the control temperature to another value between the first high value and the melting temperature of the metal but substantially closer to the melting temperature of the metal during at least the rapid heat equalization cycle and during at least the initial portion of the holding and/or conditioning cycle. After the equalization cycle, the method and system can control the capacity of the burners by a temperature in the molten metal itself. This molten metal temperature is just below the upper surface of the molten metal bath and prevents overheating of the molten metal and the hearth and compensates for temperature gradients.

50 Claims, 11 Drawing Figures

T1 = FIRST SENSED TEMP (SP1 = 2300°F, SP2 = 1600°F, SP3 = 1400°F)

T2 = SECOND SENSED TEMP (SP = 1230°F)

T4 = THIRD SENSED TEMP (SP = 1450°F)

T5 = FOURTH SENSED TEMP (SP = 1235°F)

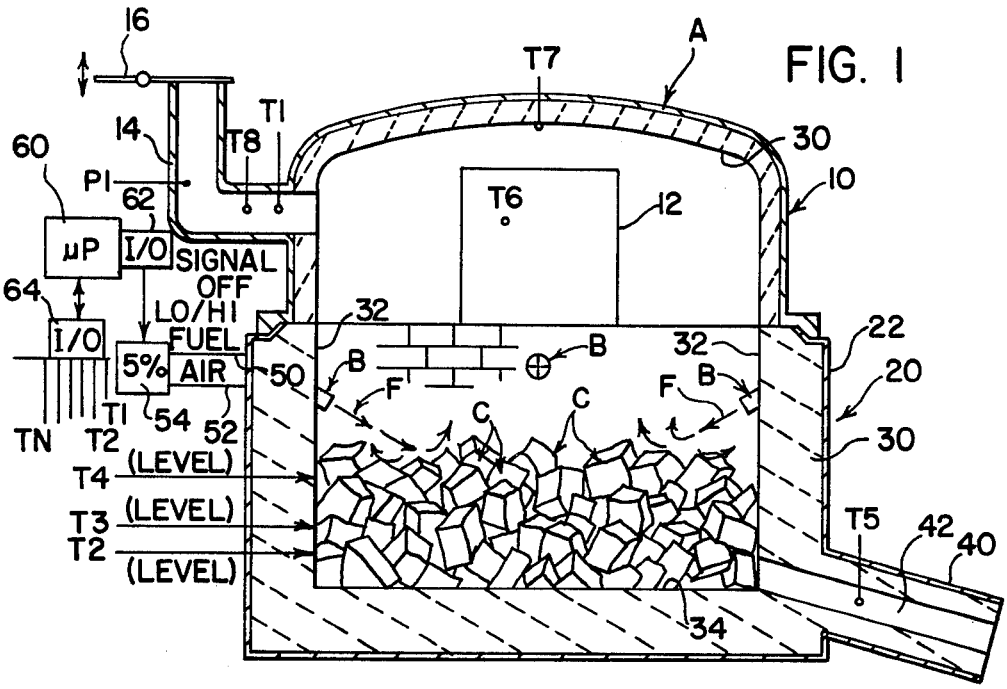
T1 = FIRST SENSED TEMP (SP1=2300°F, SP2=1600°F, SP3=1400°F)
T2 = SECOND SENSED TEMP (SP=1230°F)
T4 = THIRD SENSED TEMP (SP=1450°F)
T5 = FOURTH SENSED TEMP (SP=1235°F)
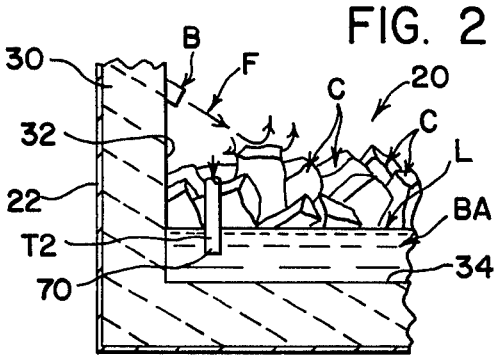

FIG. 5
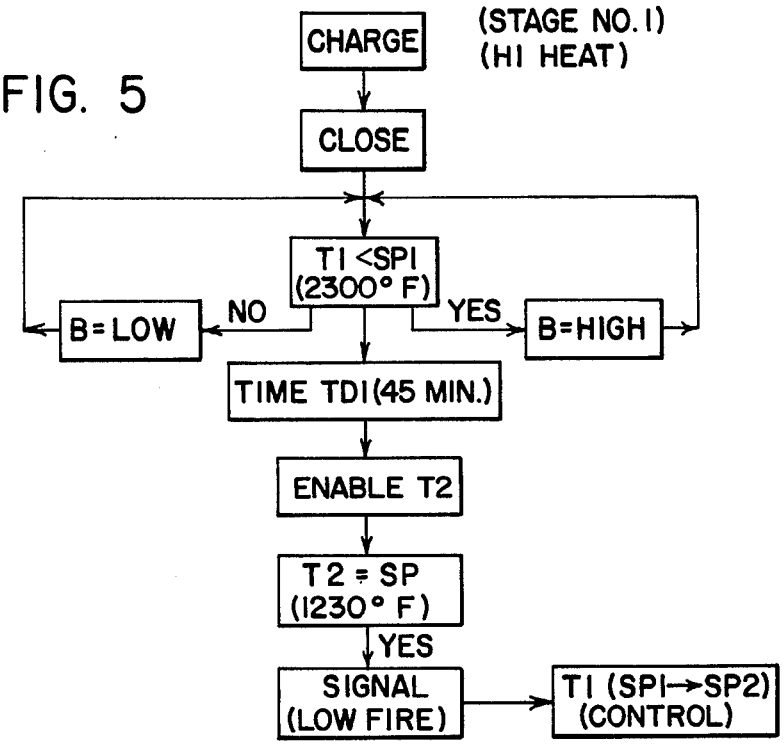
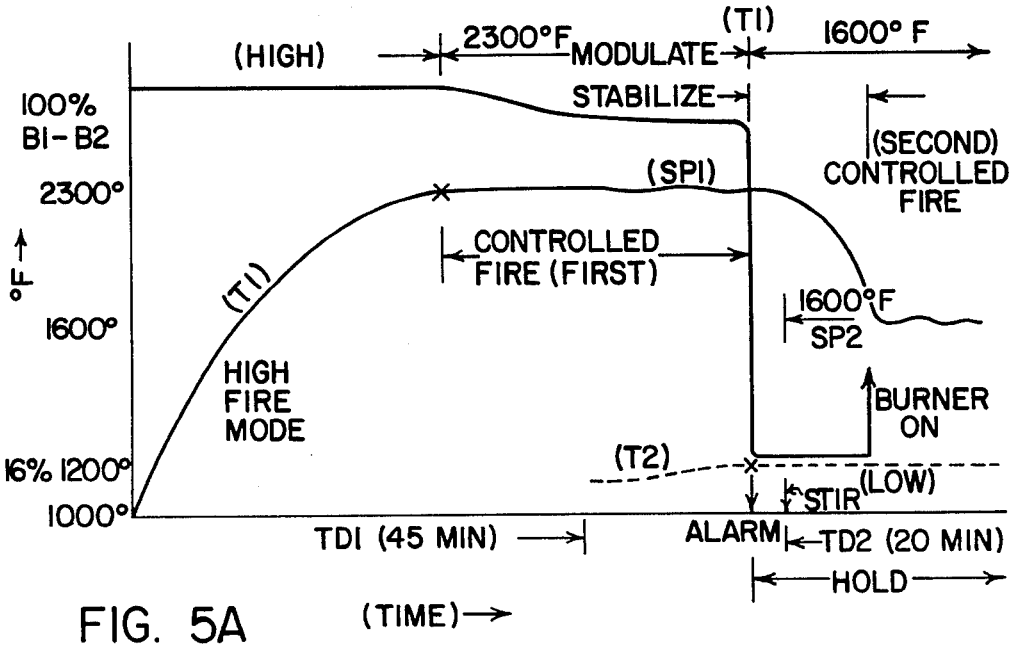
FIG. 5A

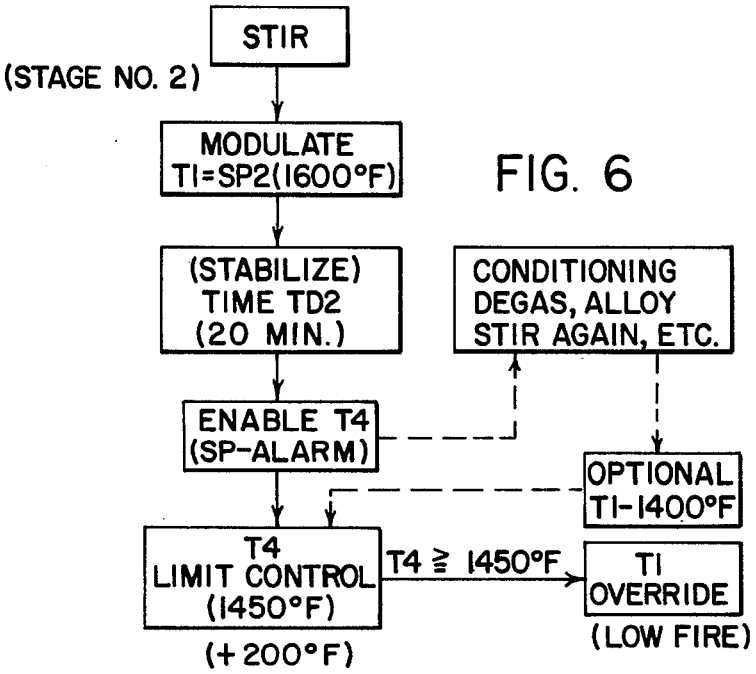
FIG. 6
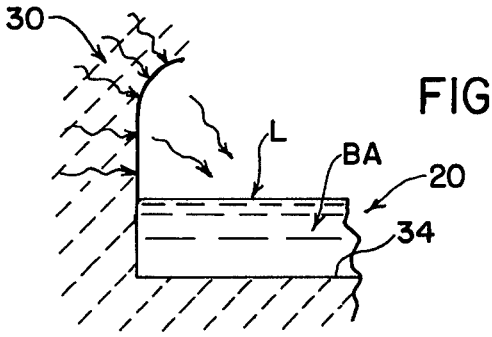
FIG. 6A
FIG. 6B
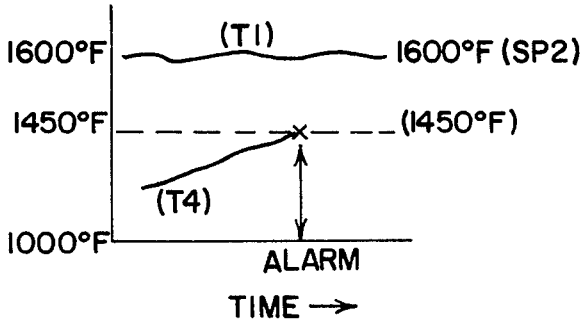

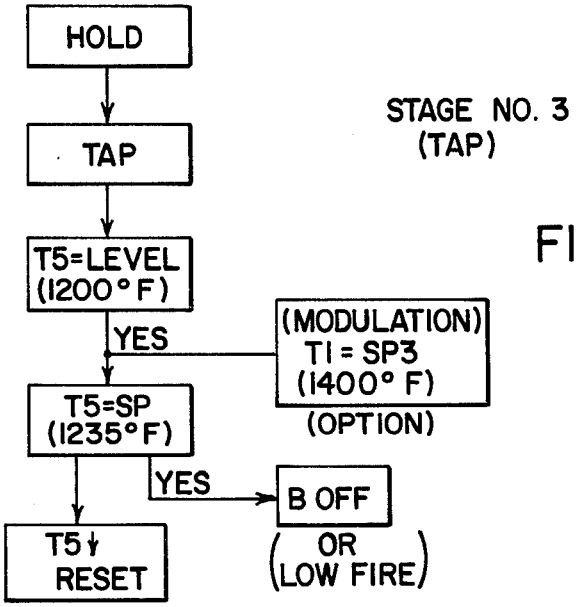
FIG. 7
FIG. 7A
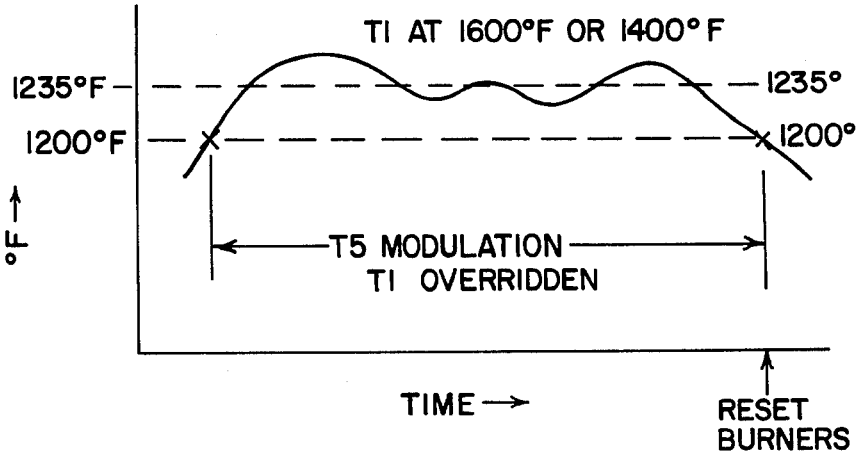

METHOD FOR MELTING A CHARGE OF BULK SOLID METAL

The present invention relates to the art of melting solid metal, such as aluminum pigs, charged into a closed hearth and more particularly to an improved method and system for melting such metal.

BACKGROUND PATENTS AND APPLICATION

The present invention relates to a method and system for controlling heating cycles created by fluid fuel burners and employs a control system of the general type disclosed in U.S. Pat. No. 4,357,135. This patent is incorporated by reference herein to show the type of control system that can be used for the various burners to practice the present invention. Of course, other types of control systems are known in the art and can be employed for that purpose. In pending application Ser. No. 389,668 high velocity burners are disclosed. These burners could be employed in practicing the invention as could be many others burners, some of which are disclosed in U.S. Pat. Nos. 3,198,855; 3,236,460; and, 3,418,062. All of these patents are incorporated by reference to show high capacity burners of the general type contemplated for use in the method and system of the present invention.

BACKGROUND OF INVENTION

The present invention relates to the art of melting metal, such as aluminum, and the invention will be described with particular reference thereto; however, it is appreciated that the invention has broader applications and maybe used for melting various type of metals, especially metals having low melting temperatures below about 1600° F.

In melting aluminum, chunks known as sows or T-bars, together with scrap and other solid aluminum pieces are charged into a hearth which is closed and then heated by a plurality of spaced burners, each of which utilizes a fluid as a fuel, such as fuel oil or natural gas. These burners direct flames at the metal charged in the holding receptacle of the hearth. Since the chunks are irregular and provide an undulating heating surface, high efficiency is somewhat difficult to obtain. To increase heating efficiency over the irregular surface caused by the chunks and pieces of solid aluminum, it has been suggested that the burners have high velocity to increase the convection heating component of the heating operation. Since solid aluminum has a conductivity in the neighborhood of 150 BTU/ft$^2$/foot thickness/°F., heating with high velocity, high capacity burners was believed to have some advantage in increasing the efficiency of the total heating operation. However, this type of heating has presented substantial difficulties. The refractory material surrounding the holding receptacle of the hearth became overheated. The aluminum, after melting, drastically increased in temperature even though thermocouples in the bath itself indicated a relatively low temperature in the molten bath. This tendency for overheating, reduced efficiency and wasted fuel. The life of the hearth was also reduced. In addition, it was often necessary for an operator to inspect the hearth during the heating operation. This was done by opening the charging door with the resultant loss of further heat.

In the past, an attempt to control the firing rate of the various burners above the molten bath has been with or by thermocouples within the molten bath itself. These thermocouples were generally located near the bottom of the bath and could sense a temperature several hundred degrees less than the temperature of the molten metal at the top of the bath. This was especially true when high velocity, high capacity burners were employed. By the time the thermocouple in the bath could sense actual melting and take action, the bath was melted and overheated. Shutdown of the burners caused the metal to continue to overheat with the resultant loss of energy and necessity for manual intervention. As can be seen, attempts to use high capacity, high velocity burners for melting aluminum has caused substantial difficulties such as overheating of the metal, overheating of the refractory walls lining the holding receptacle and general loss of control over the heating operation. Some attempts to correct this problem have involved operating the burners at less than full capacity. This resulted in a decrease in the thermal overshoot of the melting operation; however, this solution reduced the thrust of the flame against the unmelted chunks and pieces of aluminum during the initial operation. Consequently, convection heating was and is decreased. This factor reduces the efficiency of the initial heating operation. The use of the burners at reduced heating capacities thus results in a reduction of efficiency. The concept of reducing the heating capacity of the burners during the heating operation for melting aluminum and similar metal is used because the controlling thermocouples are generally the thermocouples at the lower portion of the molten bath which, at high firing rates, may be 200°–300° below the actual temperature of the molten metal bath adjacent the upper portion of the molten bath.

In view of all these difficulties, it is general practice to melt aluminum and similar low melting point alloys with a method and system wherein burners are turned down to a lower capacity so that heating occurs at a controlled rate which can respond to the lower thermocouple in a manner to prevent substantial overheating of the molten bath and of the refractory forming the metal holding receptacle of the hearth. This reduces efficiency and increases the time needed for the melting operation. Usually burners having less than 100,000 BTU/hr/ft$^2$ of bath are used in melting an average charge of aluminum.

INVENTION

The disadvantages which have resulted in decreased efficiency and low utilization factor for hearths designed to melt aluminum and similar metals have been overcome by the present invention which relates to an improved method and system for melting metal in a closed hearth.

In accordance with the present invention, there is provided a method and system of heating a charge of metal in a closed hearth having an exit gas flue. The metal has a high thermal conductivity when solid, a low thermal conductivity when liquid and a given melting temperature generally below about 1600° F. In accordance with the preferred embodiment, the metal being melted by the method and system is aluminum or aluminum alloy. A plurality of burners having a total high heat capacity sufficient to melt this metal in a given time and sufficient to drastically increase the temperature of this metal when the metal is in the liquid state are provided around the hearth. The method and system includes the concept of operating these burners at the high heat capacity until a controlled temperature associated with the hearth and separate from the metal reaches a given value, modulating the burners in the hearth to maintain this controlled temperature generally at this given value, turning the burners to a minimum capacity drastically below the high heat capacity after only part of the metal has been melted, allowing the furnace to equalize thermally and then modulating the burners to maintain the controlled temperature at another value between the first controlled value and the melting temperature of the metal which new value is substantially closer to the melting temperature than it is to the first controlled temperature.

In this manner, the temperature of the flue gases can be used to control the hearth. The burners are operated first at full fire with their maximum capacity thrusting the flames intimately into engagement with the solid aluminum within the hearth. When the flue temperature reaches a given value, such as 2300° F. for aluminum, burners are modulated to maintain this flue gas temperature. So far, no temperature is sensed from the metal itself. The high capacity burners are thrusting high energy into the metal which has a high thermal conductivity, approximately 150 BTU's/ft$^2$/ft thickness/°F. for aluminum. The flue gas temperature used to modulate the burners is substantially greater than the melting temperature of the metal. In the example for aluminum, 2300° F. is used as the initial control temperature. After only a part of the metal has become molten, the burners are turned to minimum capacity. This capacity is less than about 20% of the maximum capacity for the burners. In the preferred embodiment, the low capacity is 16% of the maximum burner capacity. The drastic turndown of the burners forms an aspect of the invention. The heat accumulated in the refractory walls which are at a temperature greater than the melting temperature of the aluminum because of the high capacity heating by all burners is conducted from the refractory walls back into the metal of the hearth. This use of heat in the walls thermally stabilizes the total charge at a temperature lower than the flue gas temperature of 2300° F. During stabilization, the burners are turned off or shifted to their low capacity, the burners are then modulated around a second flue temperature, in the preferred embodiment 1600° F. This new temperature is drastically below the original 2300° F. flue gas temperature and substantially above the melting temperature of aluminum. Thus, as soon as metal starts to melt the burners are released from control by the high level (2300° F.) value and shifted down to the low level (1600° F.) control. Consequently, there may be no need for the burners at the start of the stabilization cycle. Irrespective of this, the burners are immediately shifted to at least the low fire mode. The equalization caused by conduction from the walls of the hearth allow the burners to remain at low heat for a period of time necessary for the flue gas to shift from the first control value (2300° F.) to the second control value (1600° F.). During this thermal equalization, the burners may again be shifted to a temperature to maintain the hearth with a flue gas at the lower temperature of 1600° F.

At the time that the burners are shifted to the low fire mode (16%) it is possible to have an audio signal indicating to the operator that the furnace is ready for stirring. This assumes final melting of all metal. Whether stirred or not, the furnace is maintained at the lower flue gas temperature (1600° F.) for a set period of time. Thereafter, in accordance with another aspect of the present invention, burners are then controlled by a temperature in the molten bath itself. In accordance with another aspect of the invention, this temperature is obtained directly below the surface of the metal, in practice approximately six inches below the metal surface.

By utilizing the method and system described above, the aluminum can be melted by high burner capacity until a time directly before complete melting. Thereafter, the burners are shifted to a low fire mode, an audio signal is given and the flue gas temperature is modulated to a lower temperature. This prevents overshooting of the temperature of the metal and prevents overheating of the refractory material at the stage when the molten aluminum shifts from solid to completely liquid. In practice, as the temperature is controlled by the bath temperature, the bath is in a holding cycle and can be fluxed, alloyed and restirred.

In accordance with another aspect of the present invention, burners are controlled by a temperature of the molten metal in the aluminum directly below the surface. In this instance, the control temperature of the metal itself can be about 200° F. above the actual melting temperature of the aluminum or other metal being melted. Consequently, by having a thermocouple approximately just below the surface of the metal having a set point about 200° F. above the melting point of the metal (i.e. 1450° F.), the burners can be controlled by this thermocouple irrespective of the flue gas temperature. This thermocouple is used as an override concept. As long as the metal below the surface is less than the set point (1450° F. in the example) the flue gas temperature can control the burners to modulate around its lower value (i.e. 1600° F.). If the molten metal in the bath itself caused by heating from the burners and/or from the surrounding refractory material exceeds a value, such as the example of 1450° F., the thermocouple in the molten metal itself takes over and controls the operation of the burner in accordance with standard practice.

The metal, after being heated in accordance with the method and by the system described above, is molten and ready to be removed from the hearth. During this holding cycle, the flue gas temperature controls the burners unless the metal in the bath exceeds approximately 1450° F. In that instance, the thermocouple directly below the surface of the metal controls the burners. In accordance with another aspect of the present invention a separate control is employed when the metal is to be removed by passing molten metal through a launder. A thermocouple is placed in the launder and has a set point just below the melting temperature of the molten metal in the hearth. As this molten metal passes through the launder during tapping, the thermocouple passes through the set point. This can cause a shift in the flue gas control from the second lower value (1600° F.) to still a further value, i.e. 1400° F. Thus, during tapping of the hearth the burners are controlled by the flue gas temperatures at a further reduced value, i.e. 1400° F. This is an optional type of control of the temperature using the flue gas temperature. In accordance with another aspect of the invention, when the launder thermocouple indicates metal flow, the burners are controlled by the sensed temperature of the flowing metal.

As so far described, the flue gas can control the burners themselves in three separate stages in accordance with the present method. The first stage is during rapid fire of the burners. Then, a reduced temperature control is utilized during equalization and possibly part of the holding cycle. Thereafter, still a further flue gas temperature can be used to modulate the burners during the tapping operation. During modulation, the burners retain the same ratio of fuel to air. In practice, this is 5% excess air as is common practice in the melting art. In accordance with another aspect of the present invention, the thermocouple for sensing the temperature in the launder can operate in a system and method wherein the burners are turned off when the temperature sensed in the launder exceeds a certain temperature, such as 1230° F. As metal enters the launder, the thermocouple is immersed and the temperature immediately goes to at least the melting temperature. If the first option is employed, this immediately shifts the burners to control by the flue gas temperature at the third set point, in the preferred embodiment 1400° F. In the second option, if the temperature remains at a level above the melting temperature of the molten metal as it flows through the launder, the burners can be held in the low fire condition or possibly off. As the metal in the hearth is emptied, thermocouple or other temperature sensing device in the launder is no longer immersed in liquid metal; therefore, the sensed temperature will be reduced below the melting temperature of the metal in the hearth. When this happens, the system for modulating the burners in accordance with the flue temperature can be reset to approximately 1200° F. so that the burners remain off until the next charge of solid aluminum or other metal is loaded into the metal holding receptacle of the hearth.

In accordance with another aspect of the present invention there is provided a method of melting a charge of bulk solid metal with a known melting temperature and held in an enclosed hearth having a metal holding receptacle with an effective bath surface area. The term "bath surface area" indicates the area o the upper surface of the molten metal after melting. The hearth also has a crown, a supporting bottom and a peripherally extending wall surrounding the bath area wherein the crown and wall are formed from a mass of refractory-like material with a high thermal retentivity. A flue is provided in the hearth in accordance with standard practice for passage of products of combustion from the hearth during the heating operation. This operation is accomplished by a plurality of fluid fired burners spaced around the bath surface area with each of the burners being selectively operable in either a high fire mode with a high velocity flame projecting toward the metal in the bath area of the receptacle and a low fire mode. The heating capacity of the burners is substantially different between the high fire mode and the low fire mode. As indicated before, low fire is less than about 20% of the maximum capacity or high fire mode of the burners. In practice, the burners when heating aluminum have a total heating capacity of approximately 130,000 BTU/hr/ft$^2$ of bath area. In a low fire condition, the burners can be shifted into a capacity of approximately 20,000 BTU/hr/ft$^2$. Consequently, the number of burners is generally determined by the size of the bath. The burners should be shiftable between a high fired, high velocity condition and a low fired condition. This ratio is generally in the neighborhood of less than 20% when shifted to a low fired mode. In accordance with this aspect of the invention, this type of burner is used in a method or system involving the steps of: during a first maximum, free fired heating cycle, operating these burners in the high fired mode with the flames from the burner generally impinging upon the metal charge in the holding receptacle; sensing a first temperature at a first location associated with the hearth, the first location being away from the metal and shielded from radiation by the flame, i.e. in the flue; after the first temperature reaches a first value substantially above the melting temperature of the metal, shifting the burners to a first controlled fire heating cycle by controlling the average heating capacity to maintain this first temperature in the flue at a second value nearer the first value; after a preselected time necessary for the metal in the receptacle to be at least partially melted, sensing a second temperature at a second location associated with the hearth, the second location being in the molten metal and adjacent the bottom; after this sensed second temperature reaches a set value only slightly above the melting temperature of the metal, shifting the burners to a second controlled fire heating cycle by controlling the average heating capacity to maintain the first temperature, i.e. the flue temperature, at a third value substantially below the second value and somewhat above the melting temperature whereby heat energy stored in the mass of refractory-like material is conducted to the molten metal to thermally equalize the molten metal in the bath; and, after at least partial thermal equalization among the molten metal, heat from the burners and heat from the mass of refractory-like material during the second controlled fire heating cycle, removing at least part of the molten metal from the receptacle.

In practice the first modulated flue gas temperature is 2300° F. This is at least 1000° F. over the melting temperature of aluminum. This high differential allows for maximum heating with the burners at high fire mode for a long period during initial heating. The aluminum absorbs the heat so rapidly that the 2300° F. may not be reached until close to the shift to the lower temperature. This maximizes the high heat mode which continues generally until melting at least is started. The burners are then shifted to the low fire mode and equalization occurs.

In this manner, the bath is equalized as soon as the metal is near complete melting. This prevents overshooting and allows the burners to be turned down during the initial equalization portion of the heating method. Thus, during equalization all of the thermal gradients attempt to equalize to allow heat stored in the walls of the hearth to be conducted outwardly to maintain the temperature of the molten bath above the molten temperature even though the burners are at low fire. The heat from the walls themselves is sufficient to introduce the necessary energy to finalize the melting operation. Consequently, the burners may be turned off at the option of the control program. The final melting process by equalization prevents overheating of the furnace and allows control by the flue gas to then take over at a drastically reduced temperature.

As explained before, the first temperature of the flue gas used for modulating the burners is, when melting aluminum, 2300° F. The second temperature utilized during equalization and taking over after equalization in the preferred embodiment is approximately 1600° F. At that time, the bath is molten and ready to be stirred, then the furnace can be tapped. By immediately tapping the furnace after melting the metal, the utilization factor increases drastically for the total operation of the furnace. The utilization factor is the ratio time required for melting and total time of the cycle between charging and discharging. The discharge is a manual operation and it controls the overall efficiency; therefore, the present invention is directed toward an improved heating method and system to bring the temperature to a melting temperature and then sound an alarm or otherwise notify an operator that the molten metal is ready for subsequent conditioning and/or use.

In accordance with another aspect of the invention, the temperature is ultimately controlled by a thermocouple located just below the surface of the liquid after the melting has occurred. Thus, the temperature adjacent the portion of the bath subjected to the burner flames is used for controlling the capacity of the burners. This arrangement usually requires a certain amount of time necessary for equalization. In practice and in the illustrated embodiment when melting aluminum alloy, this time is approximately twenty minutes. This time delay (after shifting the burners to a lower control temperature) allows the temperature of the bath to fluctuate above and/or below the bath control temperature during stabilization. During the subsequent tapping and in accordance with another aspect of the invention, the burners are controlled by the temperature of the liquid metal passing through the launder.

In accordance with still another aspect of the invention, the term "high velocity" for flames from the burners indicates a velocity exceeding about 200 ft/sec. and preferably over 400 ft/sec. In addition, during the high fired mode of operation, all burners are at their maximum rated capacity. This allows the burners to produce their maximum flame length and maximum kinetic energy when impinging upon the solid aluminum. By the increased thrust of the flames, the convection component of heating is as high as possible during the initial stage of the method and system contemplated by the present invention. High burner capacity exceeds about 100,000 BTU/ft$^2$/hr. when the metal being heated is aluminum alloy. The area in "ft$^2$" relates to the ultimate area of the molten bath. The low capacity for the burners in accordance with the present invention is no more than approximately 20% of the high capacity. Of course, the burners can have low capacity, high capacity, intermediate capacity and shut-down. In each instance, it is anticipated that the proper controls are employed to maintain the desired ratio of air to fuel, which, in practice, is approximately 5% excess air. In accordance with the invention, the burners are operated at high capacity for a major portion of the initial heating. After a time and when the bath reaches a given temperature at a given, known location in the bath, the burners are shifted to a low fire mode selected to be no more than 20% of maximum high fire capacity. In accordance with this aspect of the invention the controlled temperature is then shifted to a lower value, at least about 400° F. above the molten temperature of the metal being melted.

In accordance with an aspect of the invention, the control temperatures come from the flue gas temperature instead of the temperature of molten metal during the initial maximum heat cycle and later during equalization. This is a substantial advance in the art of melting metals, such as aluminum. In the past, thermocouples in the molten metal itself have been required for control of the total melting cycle. Consequently, the heating operation was controlled only after a certain amount of melting and the burners were low capacity to prevent the impending thermal overshoot. This method still caused overheating of the refractory lining during actual melting of the metal. In accordance with the present invention, flue gas temperature above the hearth is used in controlling the initial heating operation before a temperature in the molten bath is required or obtainable. In some instances, the temperature in the molten bath may be avoided by historical data for a given furnace and a known charge. When indicating that the burner can be shifted to the low fired mode, it is contemplated that the burner can be turned off or shut down. In practice however when shifting between the high fired initial heating cycle to the equalization cycle, the burners are shut down to the low fired position which is generally at least 20% below the high fired capacity for the burners.

Other modifications and operating characteristics for the method and system of the present invention are defined in the claims of this application which form a part of the specification and are incorporated by reference herein.

The primary object of the present invention is the provision of a method and system for melting metal, such as aluminum alloy, which method and system has increased efficiency and thus reduced fuel consumption for melting a given amount of metal.

Another object of the present invention is the provision of a method and system for melting metal, as defined above, which method and system allows for the use of a high fired initial heating mode with burners operating at maximum capacity without overheating the hearth or the metal being melted in the hearth.

Still a further object of the present invention is the provision of a method and system, as defined above, which method and system allows for control of the burner by temperature sensed outside the molten metal itself with the resultant protection of the sensing mechanism from deterioration and damage and with continuity and repeatability.

Yet another object of the present invention is the provision of a method and system, as defined above, which method and system allows the use of heat stored in the hearth itself to be used in melting the metal within the hearth.

Still a further object of the present invention is the provision of a method and system, as defined above, which method and system allows control of the burners by a temperature more indicative of the actual conditions of the molten metals than methods heretofore used in melting metal, such as aluminum.

Yet another object of the present invention is the provision of a method and system, as defined above, which method and system involves rapid high heat input to the solid metal, then a drastic low burner input at the time the metal is being converted from solid to molten state. This prevents thermal overshooting and allows use of high capacity burners.

These and other objects and advantages will become apparent from the following description.

BRIEF DESCRIPTION OF DRAWINGS

FIG. 1 is a cross sectioned, schematic view showing a hearth constructed in accordance with the present invention and having a plurality of heat measuring devices together with an appropriate microprocessor for controlling operation of the hearth in accordance with the present invention;

FIG. 2 is a partial view showing metal partially melted in the hearth illustrated in FIG. 1 with thermocouple T2 enabled;

FIG. 5 is a flow diagram illustrating the method and system of melting metal, in this case aluminum, as contemplated by the preferred embodiment of the present invention;

FIG. 5A is a time graph illustrating the flue temperature, burner firing rate and other parameters employed in the preferred embodiment of the present invention, as disclosed in FIG. 5;

FIG. 6 is a flow diagram showing a further aspect of the present invention for controlling the burners used in firing the hearth, subsequent to the method and system schematically illustrated by the flow diagram in FIG. 5;

FIG. 6A is a schematic view illustrating the concept of using the initially stored heat within the refractory-like material of the hearth for supplying supplemental heat energy to melt the metal in the hearth during the heat stabilization portion of the present invention immediately following the signal by thermocouple T2;

FIG. 6B is a time graph showing the operating characteristics of the aspect of the invention schematically illustrated in FIG. 6 generally after the heat stabilization in accordance with the present invention;

FIG. 7 is a flow diagram illustrating a method and system for controlling the operation of the burners during tapping of the hearth; and, FIG. 7A is a time graph showing the operating characteristics of the aspect of the invention schematically illustrated in the flow diagram of FIG. 7.

PREFERRED EMBODIMENT

Figure 3:
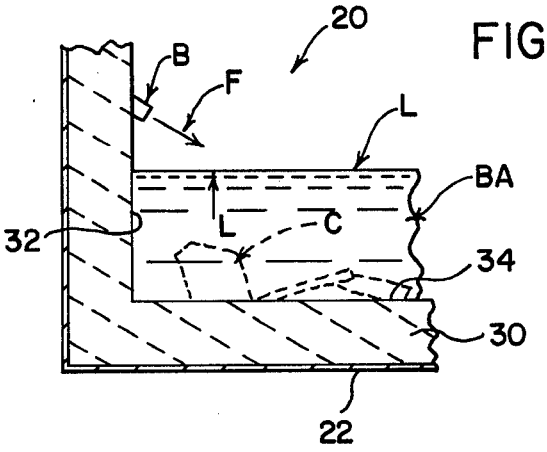
FIG. 3 is a view, similar to the view in FIG. 2, showing molten metal within the hearth just before complete melting.

Referring now to the drawings wherein the showings are for the purpose of illustrating a preferred embodiment of the method and system contemplated by the present invention and not for the purpose of limiting same, FIG. 1 shows a hearth A of the type employing a plurality of peripherally spaced burners B for the purpose of melting a charge of material indicated to be solid chunks, sows or pieces C charged into the hearth through a door, schematically illustrated as door 12, in refractory lined crown 10. Of course, the cover could be removed from the hearth for the purpose of charging solid material C into the hearth preparatory to melting. A flue 14 is controlled by a damper 16 in a manner to control the pressure within the hearth as indicated by an appropriate transducer, such as pressure sensor P1. In accordance with standard practice, positive pressure is maintained within hearth A to limit ingress of atmospheric air. In the preferred embodiment, this pressure is controlled at approximately +0.04 inches WC. The invention is particularly applicable for use in melting chunks, sows, T-bars or other masses of aluminum for the purpose of subsequent processing and will be described with particular reference thereto; however, it is appreciated that the invention has broader applications and may be used for melting other metals, especially metal having a melting point below about 1600° F. The invention is particularly applicable for use in aluminum in that the conductivity of heat to solid aluminum is approximately 150 BTU/ft$^2$/ft thickness/°F. After the metal has been melted, the molten aluminum can be raised in temperature drastically by approximately 50 BTU/ft$^2$/ft thickness/°F. The thickness relates to the depth of bath BA which has an upper level L. Thus, the metal closer to the top heats rapidly.

In accordance with the illustrated embodiment, hearth A includes a metal holding receptacle 20 having an outer, metal casing 22 for supporting a refractory-like material 30. The same type refractory material 30 is used to line crown 10 and has a thickness to preclude conduction of the energy from the hearth. This material or mass 30 absorbs and retains a high amount of heat energy instead of passing this energy through crown 10 and casing 20. The absorption of heat energy by the mass of refractory-like material 30 is employed during the heat stabilization portion of the method and system contemplated by the present invention. In practice, receptacle 20 is circular with a diameter in the range of 20–30 ft. Peripheral wall 32 and bottom 34 is defined by the refractory material or refractory mass 30 to receive and hold solid aluminum pieces C until they are melted by the plurality of burners B. A launder 40 has an inner passage 42 to allow tapping of receptacle 20 for removing molten metal from bath BA after the aluminum in receptacle 20 has been fully melted by using the method and system contemplated by the present invention. Each of the burners B is controlled by a standard fuel line 50 and a standard air line 52 at proportions or ratios controlled by device 54 so that the burners can operate at full capacity, low capacity or off. In addition, air/fuel control device 54, in accordance with standard practice, can adjust the burners between the high fire and off positions while maintaining the ratio of air. In practice this ratio is 5% excess air. In the illustrated embodiment or example, burners B have a high capacity used during the high fire mode to provide total heat to the charge of approximately 130,000 BTU/hr/square foot of bath BA when the metal is molten. At low level, the total heat provided by the burners B is less than 20% of the high, full capacity, in practice, 20,000 BTU/hr/square foot of flat bath BA. This is about 16% of the high fire, maximum heat mode. An excess of approximately 5% air is employed in accordance with standard melting practice. Control mechanisms for burners B are well known in the field and are illustrated in various patents, such as U.S. Pat. No. 4,357,135, which is incorporated by reference herein as illustrating a control system of the general type employed in operating hearth A in accordance with the present invention.

Thermocouples T1–T8 are positioned to sense temperatures at various locations in the hearth. These temperatures will be employed in operating hearth A in accordance with the preferred embodiment of the present invention. For the purposes of illustration, burner control device 54 is monitored and operated by an appropriate digital device, such as microprocessor system 60 having I/O modules 62 and 64. By accepting temperature readings from the various thermocouples and timing information, burner control 54 for the various burners B is operated in accordance with the preferred embodiment of the present invention as disclosed in the flow diagrams in FIGS. 5–7 and explained in the introductory portion of this specification. The outputs of the thermocouples is generally analog; therefore, analog to digital converting modules are employed by the digital control system for the purpose of providing digital information indicative of the temperature levels at any given time and at the various locations determined by the thermocouple. It is also possible to simulate thermocouple operations on a historical basis or otherwise to be inputted to the microprocessor system for the purpose of controlling burners A in accordance with the preferred embodiment of the present invention.

Below the hearth in FIG. 1, the set points for primary thermocouples T1, T2, T4 and T5 are set forth as employed in the preferred embodiment when hearth A is used for melting aluminum, which is the primary purpose and use of the present invention. The set point or the temperature sensed by thermocouple T1 is adjusted between 2300° F, 1600° F. and 1400° F. This is the flue gas temperature within flue 14. Microprocessor system 60 can shift the level of the set point internally in accordance with data indicating shifts in the controlled fire heating cycles required to practice the illustrated embodiment of the present invention. In addition, it is possible to use three separate thermocouples within the flue 14 each of which has a set point as disclosed in FIG. 1. Thermocouple T2 is located near the bottom 34 of receptacle 20 and, in accordance with standard practice, is contained in a protective cover or tube 70, shown in FIG. 2. This protective cover or tube is not inserted or lowered into the hearth until after melting has started so that charging of aluminum chunks or pieces C will not damage the thermocouple. In a like manner, a cover or tube 72 is used around thermocouple T4 for positioning this thermocouple approximately six inches below upper level L of bath BA when the aluminum in receptacle 20 is fully melted, or at least near complete melting as shown in FIG. 3. Thermocouple T3 is to be mounted in bath BA between thermocouple T2 and thermocouple T4; however, in the preferred embodiment of the present invention, this particular thermocouple is not connected. It would measure temperatures between the bottom of bath BA, as read by thermocouple T2, and the top of bath BA, as read by thermocouple T4.

When the bath BA is substantially melted, there will be a temperature gradient between the bottom and top of the molten bath. By employing thermocouple T3, microprocessor system 60 can be provided with digital information indicative of this vertical temperature gradient. Of course, additional thermocouples could be used in bath BA for monitoring the vertical gradient at different points in bath BA. It is also contemplated that thermocouples be employed both in the center and the periphery of bath BA. These thermocouples at several positions in the bath are represented schematically by thermocouple T3. The microprocessor system can be provided with any amount of information regarding the temperature gradient throughout bath BA for the purposes of a more accurate profile of the actual heating occurring in the bath BA.

Figure 4:
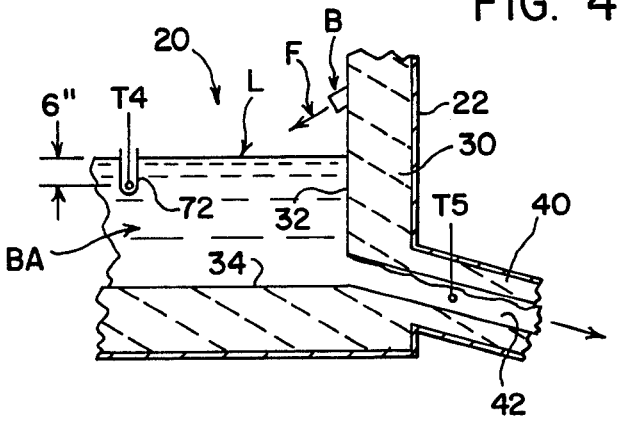
FIG. 4 is a partial view, similar to the views in FIGS. 2 and 3, showing the removal of molten metal from the hearth through a launder and the enabled position of thermocouple T4 and the position of launder thermocouple T5.

Thermocouple T5, located in passage 42 of launder 40, is normally at a relatively low temperature since it is not exposed to molten metal. When receptacle 20 is tapped, liquid flows through passage 42 as shown in FIG. 4. In this instance, thermocouple T5 measures the temperature of the metal flowing through the launder. In accordance with one aspect of the present invention, this particular temperature is monitored in a fashion illustrated schematically in FIGS. 7 and 7A. The burners are controlled by the temperature sensed at thermocouple T5. Even though T1 is at its second or third set points (1600° F. or 1400° F.), the T5 temperature overrides and turns the burners to a capacity holding the T5 set point. Thermocouple T6 measures temperature in bonnet 10. In like manner, thermocouple T7 and thermocouple T8 are employed in the cover and flue, respectively. Thermocouple T8 can be employed as a temperature limit thermocouple in the flue. These thermocouples (T6, T7, T8) monitor conditions of the hearth for the purposes of recording historical conditions of the hearth and, also for the purpose of maintenance. However, in the preferred embodiment of the invention, these particular thermocouples T6–T8 are not employed in practicing the method and system of the present invention.

In the preferred embodiment of the present invention, set point of thermocouple T2 is 1230° F. and the set point for thermocouple T4 is 1450° F. Microprocessing system 60 monitors the set points and controls device 54 as indicated in the flow diagrams. Since set points can be yes and no condition, a digit 0 or digit 1 can be used instead of A/D conversion; however, better control is obtained by digitizing at least most of the thermocouple temperatures for more versatile control. Then the set points are programmed into the system 60 in standard format. The preferred embodiment employs a set point for thermocouple T5 of 1235° F., just above the melting temperature of the aluminum. All of these values or set points are listed in FIG. 1 and are employed in the illustrated embodiment of the present invention.

Referring now to FIGS. 3–4, certain transformation conditions of bath BA are schematically illustrated. In FIG. 2, bath BA is partially melted; therefore, if thermocouple T2 has been lowered into the bath and activated by being read with microprocessor system 60, the temperature read will be at least the melting temperature of the aluminum. Indeed, it will probably be very near the melting temperature of aluminum in that it is substantially below the area of heat input from burners B. At this initial melting stage, the various pieces or chunks C of aluminum are being transformed from solid state to the liquid state. Thus, heat conductivity in the upper portion of the bath remains high whereas the heat conductivity in the lower portion is lower. Heat conductivity is indicative of the rate at which temperature of the material increases with a given amount of input energy. Thus, as long as only part of the bath is melted and it remains at the bottom portion of receptacle 20, high heat can be thrust into the aluminum without drastic increase in temperature. The high absorption situation lasts until the aluminum is at its transformation temperature. At transformation, the conductivity is lower and the aluminum heats rapidly with respect to input energy. In FIG. 3, the bath BA is nearly all liquid. Only a few chunks C are in the transformation stage. Thus, the total bath has a lower conductivity which means a drastic increase of temperature occurs at the surface. In aluminum, this ratio is approximately three to one. Thus, when only discrete chunks C remain as shown in FIG. 3, the bath can raise drastically in temperature at the same time as the chunks C are being transformed from the solid state to the liquid state. This transformation to molten metal can be assisted by stirring or other mechanical agitation. Stirring can occur by opening the doors and physically stirring the bath. This also equalizes the temperature between thermocouples T2, T3 and T4 by reducing temperature gradients in bath BA. Another manner of finalizing the molten transformation is to tap the hearth, as shown in FIG. 4. This causes turbulence in bath BA, which reduces the temperature gradients by agitation and by bringing the hotter metal from the top of hearth A to the bottom of the hearth. Final transformation of the charged solid material occurs with little additional input energy. The upper molten metal is well beyond its melting temperature and contains sufficient energy to transform the metal in bath BA which is at the molten transformation temperature. Thus, final melting can be facilitated by stirring, which brings the hot metal from the top to the bottom, or by tapping which also causes turbulence and the physical intermixing of the various portions of the bath. When bath BA becomes molten, flames directed to the top will cause a drastic gradient from top to bottom. This gradient can be reduced by stirring at the same time that the burners are turned down in accordance with the method and system of the present invention. This occurs at the "signal" step in FIG. 5.

The basic aspects of the present invention are set forth in FIGS. 5 and 5A. In accordance with the preferred embodiment of the invention, aluminum alloy is melted in hearth A. Certain various set points and parameters are shown by way of an example of a use of the invention for a bath containing about 100,000 pounds of aluminum in sow form. This bath is between 24–30 inches deep when completely melted. The top of the molten bath is referred to as the effective bath surface area and is measured in square feet. This area is used when indicating that burners B have a total heat capacity of 130,000 BTU/hr/ft$^2$ in the maximum capacity, high heat mode and a capacity of approximately 20,000 BTU/hr/ft$^2$ in the low heat capacity mode. In the preferred embodiment of the invention this definition of high heat mode and low heat mode is used for representative purposes. The relative capacities become important at shutdown by T2. This step shifts the burners immediately to 16% of their maximum capacity to heat stabilization without overheating. The burners may be turned off at this time; however, this could increase the total melting time slightly, even though it allows for maximum initial heating which is a part of the invention. A 5% excess air mixture of fuel and air is employed irrespective of the capacity of the burners.

In FIG. 5, the burners are turned off when the particles or solid chunks C of aluminum are charged into receptacle 20 of hearth A. Thereafter, the doors 12 are closed or the cover is placed over the receptacle. At that time, the burners B are shifted to high capacity to cause flames F to impinge and thrust directly against the charge C of solid material. This inputs approximately 130,000 BTU/hr/ft$^2$ of the bath BA. At the same time, the temperature of the products of combustion in flue 14 is measured by thermocouple T1. This thermocouple has a set point of 2300° F. at this initial high heat stage. The burners are operating at full capacity and inputting energy at the maximum level. This high heat or high fire mode is indicated in the first part of the curve "T1" of FIG. 5A. During the high fire mode, as much energy as possible is impinged upon and directed to the solid aluminum chunks or pieces C. Since they have a high capacity for absorption of energy, they absorb a substantial amount of the energy being directed to the aluminum. The temperature of the aluminum rises slowly in that the aluminum is a substantial heat sink. This product heat absorption tends to hold back the temperature of the products of combustion within cover 10, which temperature ultimately reaches the set point of 2300° F. Thereafter, the burners are controlled by device 54 so that the burners maintain the flue gas temperature as sensed by thermocouple T1 at or about 2300° F., in the illustrated embodiment. Burners could shift between high and low heat during this first controlled fire stage; however, in practice the burners are modulated at the desired temperature. Of course other high flue gas temperatures could be used to allow delivery of sufficient energy to the aluminum to bring it to a condition with at least partial melting in a set time TD1, which in the illustrated embodiment or example is 45 minutes. After a set time from the start of the high fire mode, i.e. TD1, thermocouple T2 is enabled. This is shown in FIG. 2 wherein the thermocouple in protective tube 70 is lowered into the bath BA. Usually the metal is melted to a greater extent than that shown in FIG. 2 after the TD1 delay. As shown in FIG. 5A, the T1 temperature is shown as reaching the first set point (2300° F.) a substantial time before thermocouple T2 is enabled. This need not occur. Indeed, T2 could be enabled before T1 reaches SP1. The SP1 value is selected to protect the hearth and is used to control the burners until thermocouple T2 takes over. When T2 is enabled, it has a set point of 1230° F. This T2 temperature is represented by the lower dashed line curve in FIG. 5A. When this temperature sensed by thermocouple T2 is 1230° F., which would mean that a substantial amount of the bath is melted as shown generally in FIG. 3, an alarm is actuated and the burners are immediately shifted to the low heat position. This is represented as the start of the hold cycle in FIG. 5A. At this time, the set point for the flue gas as represented by T1 is ultimately shifted to a value substantially below the first set point of thermocouple T1 and above the melting point of the metal. In the illustrated embodiment, the second set point for temperature of the thermocouple T1 is 1600° F. Since the furnace is at or near 2300° F., the sensed temperature by thermocouple T1 calls for no more heat. The burners remain at low fire. Indeed, they could be shifted to off for at least a short time. Since T1 has been shifted drastically from its first set point, burners are at the low fire mode which is 16% of maximum capacity, in the illustrated embodiment. The hearth now shifts to a condition wherein it is modulated or controlled at the lower temperature of 1600° F. After thermal equalization of the bath with the burners turned to low fire and held there awaiting the temperature of the flue gas to drop to the lower level of 1600° F., the burners can enter a second controlled fire heating cycle to control the flue gas temperature at thermocouple T1 at 1600° F. This equalization and second control stage, as shown in FIG. 5A, is beyond the initial heat stage as set forth in FIG. 5.

Referring now to FIGS. 6, 6A and 6B, after the signal has been received which is the "alarm" in FIG. 5A, the method and system of the present invention shifts to control T1 about the lower set point (SP2), illustrated at about 1600° F. Before that occurs, the doors 12 are usually opened and the bath is mechanically stirred. This assures melting of any solid parts in the bath and reduces the bath gradients. After the optional stirring and the shift of thermocouple T1 to SP2, i.e. 1600° F., a second timing cycle TD2 is allowed to expire. This second timing cycle allows for stabilization of the furnace as schematically illustrated in FIG. 6A. Heat in refractory like mass 30 generally above level L is conducted from the mass to top of bath BA. At the same time, the burners are at 16% fire at least until the T1 temperature is below SP2 (i.e. 1600° F.). See the "BURNER ON" position in the graph of FIG. 5A. The bath is stabilized with heat stored in the walls of the hearth during the high heat stage being conducted back to the bath to cause final melting. Hearth or melter A includes the crown 10.

As soon as thermocouple T2 reaches a temperature slightly above the melting temperature of aluminum (1230° F.), burners B are shifted t low heat mode. Then the temperature is modulated around an illustrated SP2 (1600° F.). At this time, heat from the hearth comes back into bath BA to allow final melting of the aluminum in the bath. This is considered the second stage of the total heating cycle. The first stage includes high heat, then modulation at a high temperature such as 2300° F. After the alarm has sounded in response to the temperature of T2 reaching a value just above the melting point of the metal, the doors may be opened and the flue gas damper closed. In that instance, an operator can stir the bath. This causes immediate melting of any residue chunks as shown in FIG. 3. During this time, burners B are held at low fire.

After the stirring has been accomplished and TD2 has expired, thermocouple T4 is enabled. This thermocouple is located a slight distance below upper level L of bath BA as shown in FIG. 4. In practice, this is approximately six inches. The TD2 delay allows the bath to cool somewhat during thermal stabilization so that the temperature at thermocouple T4 does not take over control at a temperature drastically above its SP, i.e. 1450. The hearth is being modulated to control T1 at 1600° F. T4 is set at some value, illustrated as about 200° above the melting point of aluminum. In this instance, a set point of 1450° F. is employed. When T4 reaches a set point of 1450° F., after the TD2 time delay, an alarm is again actuated as indicated in FIGS. 6 and 6B. At this time, an operator may condition the bath in any manner, such as fluxing, degassing, etc. In accordance with an optional step in the illustrated embodiment, the T1 temperature can be set at its SP3 set point, i.e. 1400° F. If there is no conditioning required or conditioning has been completed, control of burners B is shifted to the thermocouple T4 at its set point (1450° F.).

As illustrated in FIG. 6B, during the HOLD cycle as hearth A awaits tapping, burners B are controlled by T1 at 1600° F. unless the temperature of T4 exceeds 1450° F. In that instance, burners B are controlled by the temperature sensed by thermocouple T4. During this HOLD cycle burners B are controlled to modulate the flue gas at a second set point (1600° F.); but, the metal in the bath, just below the surface upon which flames F impinge, is controlled at approximately 1450° F. In view of the gradient between the upper and lower part of the bath, this upper bath temperature has proven satisfactory in practice for overriding T1 control during the HOLD cycle and after thermal stabilization. Several thermocouples could be placed at various depths and locations in the bath to control burners B in accordance with the actual bath temperature as an override to the flue gas control. The flue gas control is preferred since there is less likelihood of damage or deterioration of the thermocouple located in the flue.

As so far explained, the method and system of controlling hearth A has provided a molten bath of metal, such as aluminum, which has not drastically exceeded the melting temperature of the metal and which as equalized and temperature in the bath at the time of melting so that there is no overshooting and overheating of the hearth itself even without manual intervention.

Referring now to FIGS. 4, 7, and 7A, the tapping cycle or third heating stage of the total cycle is schematically illustrated. In this instance, the temperature of the bath is controlled in accordance with the feature schematically illustrated in the graph of FIG. 7A. When it is necessary to tap the hearth, liquid metal flows through passage 42 of launder 40. The thermocouple T5 will sense a temperature exceeding 1200° F. When this occurs, burners B are controlled by the temperature of thermocouple T5 to modulate or control the T5 temperature at about 1235° F. If the metal exceeds this temperature, burners B are shifted to low heat mode or are turned off. If the T5 temperature does not exceed this SP (i.e. 1235° F.), burners B are on at the low fire mode or above. As an option shown in FIG. 7, the set point for T1 may be shifted to a still lower SP3 temperature, i.e. 1400° F. Then, T1 modulates the burners around 1400° F. unless T5 overrides this control during the tapping operation. When the metal stops flowing through passage 42, the temperature at thermocouple T5 shifts below 1200° F. This can cause the burners to be held either off if the hearth is empty or at the low fire mode if the hearth is only partially empty. In accordance with an aspect of the preferred embodiment, where the T5 temperature drops below 1200° F., the hearth is RESET. A further set point for T1, i.e. 1200° F., can be implemented awaiting the next charge.

Burners B are controlled at various stages according to the condition of the molten metal in the hearth so that the maximum amount of heat energy is directed toward and into the metal when it is solid. In the molten condition the system and method shifts burners B to various fired capacities which may be controlled by the flue gas temperature and overridden, in certain instances, by the actual condition of the molten metal in the bath. The concept of controlling burners B by the flue gas temperature with overrides in the bath itself allows efficient operation of hearth A. If hearth A is tapped immediately after conditioning and the alarm, shown in FIG. 6B, the utilization factor of the furnace is higher than the normal 66%. This factor, taken together with the increased efficiency caused by the use of the present invention, substantially decreases the total fuel consumption per pound of metal converted from solid to liquid.

In the present invention, the T1 temperature may not reach its SP1 temperature before T2 reaches its set point. This would be an ideal development in that the burners would be shifted to the low fire mode before they have been modulated by the flue gas temperature. Since this would involve the reduction of first controlled fire heating cycle in FIG. 5A to zero, maximum heat input from burners B is obtained. The invention of rapid heat until the T2 metal temerature reaches a given value, allows an aluminum furnace to be fired initially at 130,000 BTU/hr/ft$^2$ of bath where a maximum of 100,000 BTU/hr/ft$^2$ of bath was previously used. In addition the T2 temperature can be at least 100° F. before bath temperature sensors previously relied upon since it senses initial melting as opposed to bath temperature for temperature control. In the present invention the T4 thermocouple performs the holding control and is placed in a position to compensate for closeness to the burner flames. In the past a single sensor at the position of T2 was used. It had to read a high value substantially above the melting point to be assured of total melt down of metal above the thermocouple. The concept of the invention allows T2 to sense only partial melting and at a lower temperature.

In practice the 200 ft/second flame speed is sometimes defined as high velocity. In the preferred embodiment of the invention, the burners have a flame velocity of at least 400 ft/sec. When low fire mode of the burners is used, it is possible for system 60 to shut the burners down in some situations; however, this may involve prepurging when the burners are brought up to heat; therefore, shut down really means minimum fire with continued operation. This can be before the 16% turndown in the low fire mode shown in FIG. 5A.

Changes can be made to the size of the hearth, various set point temperatures and related control features without changing the basic concept of the method and system contemplated by the present invention.

Having thus described the invention, it is claimed:

1. A method of melting a charge of bulk solid metal with a known melting temperature and held in an enclosed hearth having a metal holding receptacle with an effective bath surface area, a crown, a supporting bottom and a peripherally extending wall surrounding said bath area, said crown and said wall being formed by a mass of refractory-like material with a high thermal retentivity, a flue for passage of gases from said hearth, and a plurality of fluid fired burners spaced in said area, each of said burners being selectively operative in either a high fire mode with a high velocity flame projecting toward said metal in said bath area of said receptacle and a low fire mode, the heating capacity of said burners being substantially different between said high fire mode and said low fire mode, said method comprising the steps of:

(a) during a first maximum, free fire heating cycle, operating said burners in said high fire mode with the flames from said burners generally impinging upon said metal charge in said receptacle;

(b) sensing a first temperature at a first location associated with said hearth, said first location being away from said metal and shielded from radiation by said flames (c) after said first temperature reaches a first value substantially above said melting temperature of said metal, shifting said burners to a first controlled fire heating cycle by controlling the average heating capacity to maintain said first temperature at a second value near said first value;

(d) after a preselected time necessary for said metal in said receptacle to be at least generally melted, sensing a second temperature at a second location associated with said hearth, said second location being in said molten metal and adjacent said bottom;

(e) after said sensed second temperature reaches a set value only slightly above said melting temperature, shifting said burners to a second controlled fire heating cycle by controlling the average heating capacity to maintain said first temperature at a third value substantially below said second value and somewhat above said melting temperature whereby heat energy stored in said mass of refractory-like material is conducted to said metal to thermally equalize said molten metal in said bath; and, (f) after at least partial thermal equalization among the molten metal, heat from the burners and heat from said mass of refractory-like material during said controlled fire heating cycle, removing at least part of said molten metal from said receptacle.

2. The method as defined in claim 1, wherein said high velocity flames exceed 400 ft/sec.

3. The method as defined in claim 1, wherein said high fire mode includes the step of firing all of said burners at their maximum rated capacity.

4. The method as defined in claim 3, wherein said burner capacity during said high fire mode exceeds 100,000 Btu/ft$^2$/hr wherein said metal is aluminum alloy and said ft$^2$ relates to said bath area.

5. The method as defined in claim 4, wherein said burner capacity during said low fire mode does not exceed 20% of the burner capacity during said high fire mode.

6. The method as defined in claim 1, wherein said burner capacity during said low fire mode does not exceed 20% of the burner capacity during said high fire mode.

7. The method as defined in claim 1, wherein said first location is in said flue.

8. The method as defined in claim 7, wherein said first and second values of said first temperature are substantially the same.

9. The method as defined in claim 1, wherein said first and second values of said first temperature are substantially the same.

10. The method as defined in claim 1, wherein said step of shifting said burners to a second controlled fire heating includes the step of first shifting said burners to said low fire mode.

11. The method as defined in claim 10, wherein said burner capacity during said low fire mode does not exceed 20% of the burner capacity during said high fire mode.

12. The method as defined in claim 11, wherein said burner capacity during said low fire mode is burner shut down.

13. The method as defined in claim 1, wherein said metal is aluminum alloy with a melting temperature in the general range of 1220° F.–1230° F.

14. The method as defined in claim 13, wherein first location is in said flue.

15. The method as defined in claim 14, wherein said first value of said first sensed temperature is over about 2000° F.

16. The method as defined in claim 15, wherein said first value is approximately 2300° F.

17. The method as defined in claim 13, wherein said first value of said first sensed temperature is over about 2000° F.

18. The method as defined in claim 15, wherein said third value of said sensed temperature is about 1600° F.

19. The method as defined in claim 16, wherein said third value of said sensed temperature is about 1600° F.

20. The method as defined in claim 15, wherein said third value of said sensed temperature is about 1600° F.

21. The method as defined in claim 13, wherein said set value of said second sensed temperature is less than about 10° F. over said melting temperature.

22. The method as defined in claim 1, wherein said set value of said second sensed temperature is less than about 10° F. over said melting temperature.

23. The method as defined in claim 1 wherein said second controlled fire heating cycle occurs a short time after step (c).

24. The method as defined in claim 23 wherein said short time is zero whereby said step (c) is overridden by said second sensed temperature reaching said set value before said first sensed temperature reaches said first value.

25. The method as defined in claim 1 including the further step of shutting down said burners when said second sensed temperature exceeds said set value by a substantial amount.

26. The method as defined in claim 25, wherein said substantial amount is about 20° F.

27. The method as defined in claim 1 including the step of mechanically agitating said bath just before said burners are shifted to said second controlled heating cycle.

28. The method as defined in claim 1 including the further steps of:

(g) a substantial time after step (e) and before removal as in step (f), sensing a third temperature at a third location associated with said hearth, said third location being just slightly below the upper surface of the molten metal in said receptacle; and, (h) shifting said burners to the low fire mode whenever said third sensed temperature exceeds a given value substantially above said melting temperature.

29. The method as defined in claim 28, wherein said metal is aluminum alloy and said given value is at least 1300° F.

30. The method as defined in claim 29, wherein said given value is about 1450° F.

31. The method as defined in claim 28, wherein said substantial time is about 20 minutes.

32. The method as defined in claim 1, wherein said predetermined time is about 45 minutes.

33. The method as defined in claim 1, wherein said removing step includes flow of molten metal through a launder from said receptacle and including the further steps of:

(g) sensing a fourth temperature at a fourth location associated with said hearth, said fourth location being in said launder and subjected to molten metal only during removal of molten metal from said receptacle; and, (h) shutting down said burners whenever said fourth sensed temperature exceeds a given exit temperature about said melting temperature.

34. The method as defined in claim 33, wherein said metal is aluminum alloy and said exit temperature is about 1230° F.

35. The method as defined in claim 1 wherein said removing step includes flow of molten metal through a launder from said receptacle and including the further step of:

(g) sensing a fourth temperature at a fourth location associated with said hearth, said fourth location being in said launder and subjected to molten metal only during removal of molten metal from said receptacle; and, (h) after said sensed fourth temperature reaches a set value only slightly above said melting temperature shifting said burners to a third controlled fire heating cycle by controlling the average heating capacity to maintain said fourth temperature at a set value somewhat above said melting temperature.

36. The method as defined in claim 35 including the step of:

(i) shutting down said burners whenever said fourth sensed temperature exceeds and then drops below said melting temperature.

37. The method as defined in claim 1 including the step of maintaining the ratio of fuel to air generally constant during said first and second controlled fire heating cycle.

38. A method of melting a charge of bulk solid aluminum alloy with a known melting temperature and held in an enclosed hearth having a metal holding receptacle with an effective bath surface area, a crown, a supporting bottom and a peripherally extending wall surrounding said bath area, said crown and said wall being formed by a mass of refractory-like material with a high thermal retentivity, a flue for passage of gases from said hearth, and a plurality of fluid fired burners spaced in said area, each of said burners being selectively operative in either a high fire mode with a high velocity flame projecting toward said metal in said bath area of said receptacle and a low fire mode, the heating capacity of said burners being substantially different between said high fire mode and said low fire mode, said method comprising the steps of:

(a) during a first maximum, free fire heating cycle, operating said burners in said high fire mode with the flames from said burners generally impinging upon said aluminum charge in said receptacle;

(b) sensing a first temperature at a first location associated with said hearth, said first location being away from said metal and shielded from radiation by said flames;

(c) after said first temperature reaches a first value substantially above said melting temperature of said aluminum, shifting said burners to a first controlled fire heating cycle by controlling the average heating capacity to maintain said first temperature at a second value near said first value;

(d) after only some of said aluminum is molten shifting said burners to a second controlled fire heating cycle by controlling the average heating capacity to maintain said first temperature at a third value substantially below said second value and somewhat above said melting temperature whereby heat energy stored in said mass of refractory-like material is conducted to said metal to thermally equalize said molten metal in said bath; and, (e) after at least partial thermal equalization among the molten metal, heat from the burners and heat from said mass of refractory-like material during said second controlled fire heating cycle, removing at least part of said molten metal from said receptacle.

39. The method as defined in claim 38, including the further steps of:

(f) a substantial time after step (d) and before removal as in step (e), sensing the temperature of molten aluminum slightly below the upper surface of the molten aluminum bath; and, (g) shifting said burners to the low fire mode whenever the temperature sensed slightly below said upper surface exceeds a given value substantially above the melting temperature of said aluminum alloy.

40. The method as defined in claim 39, wherein said given value is greater than about 1300° F.

41. A method of melting a charge of bulk solid aluminum alloy with a known melting temperature and held in an enclosed hearth having a metal holding receptacle with an effective bath surface area, a crown, a supporting bottom and a peripherally extending wall surrounding said bath area, said crown and said wall being formed by a mass of refractory-like material with a high thermal retentivity, a flue for passage of gases from said hearth, and a plurality of fluid fired burners spaced in said area, each of said burners being selectively operative in either a high fire mode with a high velocity flame projecting toward said metal in said bath area of said receptacle, and a low fire mode, the heating capacity of said burners being substantially different between said high fire mode and said low fire mode, said method comprising the steps of:

(a) during a first maximum, free fire heating cycle, operating said burners in said high fire mode with the flames from said burners generally impinging upon said metal charge in said receptacle;

(b) if said hearth reaches a given temperature, controlling said burners to maintain in said hearth a high temperature substantially above the melting temperature of said aluminum alloy; and, (c) after said charge is partially melted and before said charge is fully melted, shifting said burners into said low fire mode whereby heat energy in said mass of refractory-like material is conducted to said metal for final melting.

42. The method as defined in claim 41, including the step of:

(d) upon shifting said burners to said low fire mode, controlling said burners to maintain in said hearth in intermediate temperature substantially lower than said high temperature and substantially above the melting temperature of said aluminum alloy.

43. The method as defined in claim 42, wherein said high temperature is generally 2300° F. and said intermediate temperature is at least about 1500° F.

44. A method of heating a charge of metal in a loaded hearth with an exit gas flue, said metal having a first high thermal conductivity when solid, a second low conductivity when liquid and a given melting temperature below about 1600° F., a plurality of burners having a total high heat capacity sufficient to melt said metal in a given time and sufficient to drastically increase the temperature of said metal when said metal is in a liquid state, said method comprising the steps of:

(a) operating said burners at said high heat capacity until a control temperature associated with said hearth and separate from said metal reaches a given value;

(b) modulating said burners to maintain said control temperature generally at said given value;

(c) turning said burners to a minimum capacity drastically below said high heat capacity after only part of said metal has melted;

(d) then allowing said furnace to equalize thermally; and, (e) modulating said burners to maintain said control temperature to another value between said given value and said melting temperature but substantially closer to said melting temperature than to said given temperature.

45. The method as defined in claim 44 including the further step of controlling said burners by a temperature in said molten metal after said equalizing step.

46. The method as defined in claim 44 wherein said modulating steps shift said burners between said high heat capacity and a low heat capacity wherein said low heat capacity is no greater than about 20% of said high heat capacity.

47. A method of heating a charge of metal in a loaded hearth with an exit gas flue, said metal having a first high thermal conductivity when solid, a second low conductivity when liquid and a given melting temperature below about 1600° F., a plurality of burners having a total high heat capacity sufficient to melt said metal in a given time and sufficient to drastically increase the temperature of said metal when said metal is in a liquid state, said method comprising the steps of:

(a) operating said burners at said high heat capacity;

(b) detecting a first time when said metal is partially melted;

(c) detecting the time when a control temperature in said flue reaches a given value;

(d) modulating said burners to maintain said control temperature generally at said given value until said first time is detected;

(e) turning said burners to a minimum capacity drastically below said high heat capacity after said first time is detected;

(f) then allowing said furnace to equalize thermally with said burners at said minimum capacity; and, (g) then modulating said burners to maintain said control temperature to another value between said given value and said melting temperature but substantially closer to said melting temperature than to said given temperature.

48. The method as defined in claim 47 including the further step of controlling said burners by a temperature in said molten metal after said equalizing step.

49. The method as defined in claim 48 including the step of mechanically stirring said molten metal before step (g).

50. A method of melting a charge of bulk solid aluminum alloy with a known melting temperature and held in an enclosed hearth having a metal holding receptacle with an effective bath surface area, a supporting bottom and a peripherally extending wall surrounding said bath area, said bottom and said wall being formed by a mass of refractory-like material with a high thermal retentivity, a flue for passage of gases from said hearth, and a plurality of fluid fired burners spaced in said area, each of said burners being selectively operative in either a high fire mode with a high velocity flame projecting toward said metal in said bath area of said receptacle, and a low fire mode, the heating capacity of said burners being substantially different between said high fire mode and said low fire mode, said method comprising the steps of:

(a) during a first maximum, free fire heating cycle, operating said burners in said high fire mode with the flames from said burners generally impinging upon said metal charge in said receptacle;

(b) after said charge is in a state where said charge is partially melted and before said charge is fully melted, shifting said burners into said low fire mode whereby heat energy in said mass of refractory-like material is conducted to said metal for final melting;

(c) sensing a temperature of said hearth and at a location spaced from said charge; and, (d) interrupting said free fired heating cycle when said sensed temperature exceeds a preselected value.

* * * * *